US005402034A

United States Patent [19]

Blouch et al.

[11] Patent Number: 5,402,034

[45] Date of Patent: Mar. 28, 1995

[54] CONDUCTIVE COATING FOR AN IMAGE INTENSIFIER TUBE MICROCHANNEL PLATE

[75] Inventors: Walter E. Blouch, Blue Ridge; Daniel D. Duggan, Roanoke; Larry E. Reed, Vinton, all of Va.

[73] Assignee: ITT Corporation, New York, N.Y.

[21] Appl. No.: 257,939

[22] Filed: Jun. 10, 1994

Related U.S. Application Data

[63] Continuation of Ser. No. 919,766, Jul. 24, 1992, abandoned.

[51] Int. Cl.[6] ..... H01J 31/50

[52] U.S. Cl. ..... 313/370; 313/534; 313/103 CM; 313/528

[58] Field of Search ..... 313/116, 370, 377, 379, 313/383, 387, 390, 528, 534, 103 CM; 250/315.3, 327.2 R

[56] References Cited

U.S. PATENT DOCUMENTS

| | | | |
|---|---|---|---|
| 3,708,673 | 1/1973 | Blacker, Jr. | 313/534 |
| 3,969,624 | 7/1976 | Van Biesen et al. | 250/315.3 |
| 4,140,900 | 2/1979 | Wang | 313/526 |
| 4,950,939 | 8/1990 | Tosswill | 313/103 CM |
| 5,023,511 | 6/1991 | Phillips | 313/528 |
| 5,132,586 | 7/1992 | Boulais et al. | 313/103 CM |
| 5,159,231 | 10/1992 | Feller et al. | 313/103 CM |

*Primary Examiner*—Donald J. Yusko
*Assistant Examiner*—Vip Patel
*Attorney, Agent, or Firm*—Arthur L. Plevy; Patrick M. Hogan

[57] ABSTRACT

An image intensifier tube having a conductive coating for draining away accumulated electrons that cause the image intensifier tube to lose resolution. The conductive coating is formed on the insulating surface of the image intensifier tube microchannel plate. The conductive coating is formed from the evaporation of cathode sublimation products which include barium, nickel and tungsten.

16 Claims, 5 Drawing Sheets

OUTSIDE OF WEDGE AREA

WEDGE AREA

CONDUCTIVE COATING FOR AN IMAGE INTENSIFIER TUBE MICROCHANNEL PLATE

This invention was reduced to practice under United States Government contract number DAAB07-85-C-E032 for the Department of the Army.

This is a continuation of application Ser. No. 07/919,766, filed on Jul. 24, 1992, entitled CONDUCTIVE COATING FOR AN IMAGE INTENSIFIER TUBE MICROCHANNEL PLATE, now abandoned.

FIELD OF THE INVENTION

This invention relates to image intensifier tubes and more particularly, to an image intensifier tube microchannel plate having a conductive coating.

BACKGROUND OF THE INVENTION

Image intensifier tubes are utilized to enhance night time vision without using additional light. These devices have both military and industrial applications. The U.S. military uses image intensifier tubes for viewing and aiming at targets at night that otherwise would not be visible. In addition, image intensifier tubes are used by aviators to enhance night time vision, for providing night vision to people who suffer from night blindness (retinitis pigmentosa) and for photographing astronomical bodies.

Generally, an image intensifier tube includes three main components. These components include a photocathode, a phosphor screen (anode) and a microchannel plate (MCP) disposed between the photocathode and anode. The photocathode is a photoemissive wafer that is extremely sensitive to low radiation levels of light in the 580–900 nm spectral range. When electromagnetic radiation impinges on the photocathode, the photocathode emits electrons in response.

The MCP is a relatively thin glass plate having input and output planes and an array of microscopic holes through it. An electron impinging on the MCP results in the emission of a number of secondary electrons which, in turn, cause the emission of more secondary electrons. Therefore, each microscopic hole acts as a channel type secondary emission electron multiplier having an electron gain of approximately several hundred. The electron gain is primarily controlled by a potential difference between the input and output planes of the MCP. Consequently, the MCP increases the density of electron emission.

The anode includes an output fiber optic window and a phosphor screen which is formed on a surface of the window. Emitted electrons are accelerated towards the phosphor screen by maintaining the phosphor screen at a higher positive potential than the MCP. The phosphor screen converts the electron emission into an image which is visible to an operator.

A type of image intensifier tube known in the prior art is a GEN III Image Intensifier Tube, which is manufactured by ITT Electro Optical Products Division in Roanoke, Virginia. This type of tube utilizes a :photocathode manufactured from gallium arsenide. Such photocathodes are susceptible to being bombarded by positive ions from the MCP, thus degrading the performance of the photocathode. A method utilized to inhibit positive ion bombardment of the photocathode includes coating the MCP with an insulating film of aluminum oxide. This film acts as an ion barrier thus protecting the photocathode and maintaining its performance capabilities.

Resolution of an image intensifier tube is based upon its ability to resolve line pairs. When exposed to a bright source, however, the photocathode emits an increased number of electrons. Due to MCP gain, the increase in electrons generally causes some channels in the MCP to become saturated. This saturation degrades the resolution of the image intensifier tube. As the source becomes brighter, more electrons are emitted by the photocathode, causing more channels in the MCP to become saturated and a further degradation of resolution.

A method utilized to improve resolution of an image during high light conditions employs bright source protection circuits in the power supply. Generally, these circuits lower the potential supplied to the photocathode in response to high light conditions, thus reducing the photo current of the photocathode and the energy of the emitted electrons. However, if the voltage is lowered such that the emitted electrons from the photocathode do not have sufficient energy to penetrate the insulating film, they will begin to accumulate on the film. Consequently, the photocathode voltage is essentially lowered to the secondary emission crossover voltage of the insulating film. This crossover voltage, commonly known as a tube clamp voltage, causes the image produced by the tube to fade out as the insulating film accumulates a negative charge.

To prevent the image from fading out, the bright source protection circuit clamps the photocathode voltage above the tube clamp voltage. This is achieved by maintaining the photocathode at a power supply clamp voltage. Consequently, the image intensifier has the capability of providing acceptable resolution under severe high light conditions.

A predetermined amount of resolution degradation is acceptable in an image intensifier tube. During a high light resolution test, the photocathode is exposed to a relatively high light (i.e. 20 foot-candles) which includes a resolution pattern. Consequently, the power supply senses a high photocathode current and goes into bright source protection mode by lowering the photocathode voltage and the MCP operating voltage. Both of these changes reduce the flow of electrons through the insulating film, causing the electrons to accumulate on the film. Consequently, this causes a degradation in resolution. However, as long as the power supply clamp voltage is kept above the tube clamp voltage, the resolution pattern remains acceptable (i.e. greater than or equal to 5 line pairs per mm) during the high light resolution test.

The power supply clamp voltage is selected between a range of 28–44 volts. However, the tube clamp voltage is not always known since it is determined by the secondary emission characteristics of the insulating film. Typically, the tube clamp voltage will vary from 15 to 30 volts. Moreover, the tube clamp voltage is dependent upon the insulating film thickness, surface conductivity, bulk conductivity, the manufacturing process utilized, and the material used to fabricate the film.

The thickness of the insulating film is an important element in an image intensifier tube's performance. Typically, the film is only 30 to 50 angstroms thick and is extended over a 10 micron diameter opening. This is equivalent to stretching a 0.0005 inch sheet of material such as MYLAR over a 1 inch diameter hole. Consequently, the thickness of the insulating film is dependent on the manufacturing process and is difficult to control. If the resulting film thickness is sufficiently thin, it may not endure normal manufacturing processes, including vacuum baking. This would result in a degradation of the photocathode performance since it would not be protected from positive ion bombardment. If the film is too thick, it will impede the transmission of electrons emitted from the photocathode and reduce the signal to noise ratio.

Therefore, secondary emission characteristics of the insulating film and tube clamp voltage varies for each image intensifier tube. Consequently, the problem of image intensifier tube resolution is exacerbated if the voltage difference between the substantially constant power supply clamp voltage and the tube clamp voltage is sufficient to cause electrons to accumulate on the insulating film.

In vacuum tubes utilizing a glass or ceramic vacuum envelope, the envelope wall generally includes the uncontrolled insulating film. In such tubes, the secondary emission characteristics on the surface can be controlled by a high resistance coating of chrome oxide or iron oxide. Such coatings provide acceptable results when used on the wall of the envelope. However, in an image intensifier tube such as the GEN III, the insulating film is an integral element of the tube's operating parameters and such coatings degrade tube performance.

One method of alleviating the above noted problems includes providing surface conductivity to the insulating film. This includes covering the insulating film with a conductive coating. Due to its conductivity, the coating alleviates the accumulation of electrons and thus negative charges on the insulating film.

It is desirable that such a conductive coating be sufficiently thin so that the tube's performance is not substantially degraded. As is well known in the art, fabricating such a thin conductive coating with a uniform thickness is difficult to achieve with present manufacturing processes. Therefore, it is an object of the present invention to provide a conductive coating that is sufficiently thin so that a tube's performance is not degraded. In addition, it is an object of the present invention to provide a conductive coating that alleviates the accumulation of electrons on the insulating film of an image intensifier tube microchannel plate.

SUMMARY OF THE INVENTION

In an image intensifier tube having an insulating surface on which a negative charge forms causing an image produced by said tube to fade out, the improvement therewith comprising a conductive coating formed on said insulating surface for removing said negative charge from said insulating surface.

DETAILED DESCRIPTION OF THE INVENTION

Image intensifier tubes are well known in the industry by their commonly used generic names which are based on the generation from which their design came into being. Such tubes have evolved from Generation (GEN) 0 to GEN III.

Figure 1:
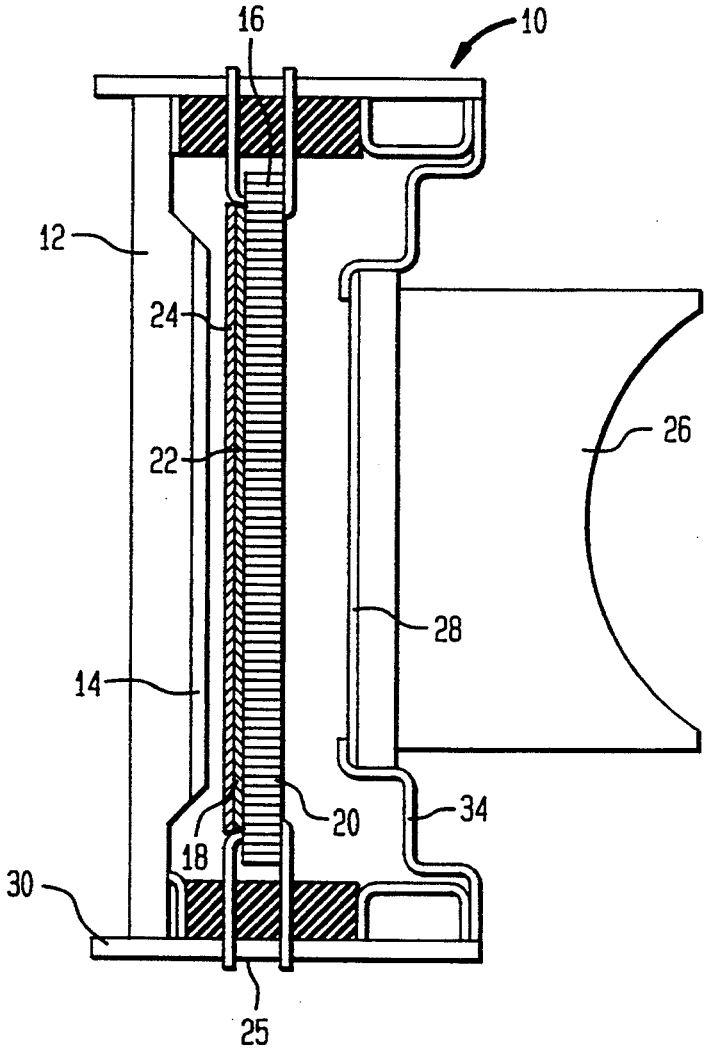
FIG. 1 is a cross sectional side view of an image intensifier tube in accordance with the present invention.

Referring to FIG. 1, an image intensifier tube 10 in accordance with the present invention is shown. The tube 10 includes an input window 12 having a photoemissive wafer 14 which together function as a cathode. There are many types of such photocathodes known in the art. In this regard, reference is made to a book entitled "Reference Data for Radio Engineers", sixth edition, second printing-1977, published by Howard W. Sams & Co., Inc., a subsidiary of ITT Corporation, pgs 17-4 to 17-8; . Photocathodes designated as S-20 are utilized in GEN I tubes while S-25 photocathodes are utilized in GEN II tubes. Another type of photocathode utilizes a photoemissive wafer fabricated from improved multialkali materials. Moreover, photocathodes having a photoemissive wafer fabricated from GaAs: Cs·O are utilized in GEN III tubes.

Figure 2:
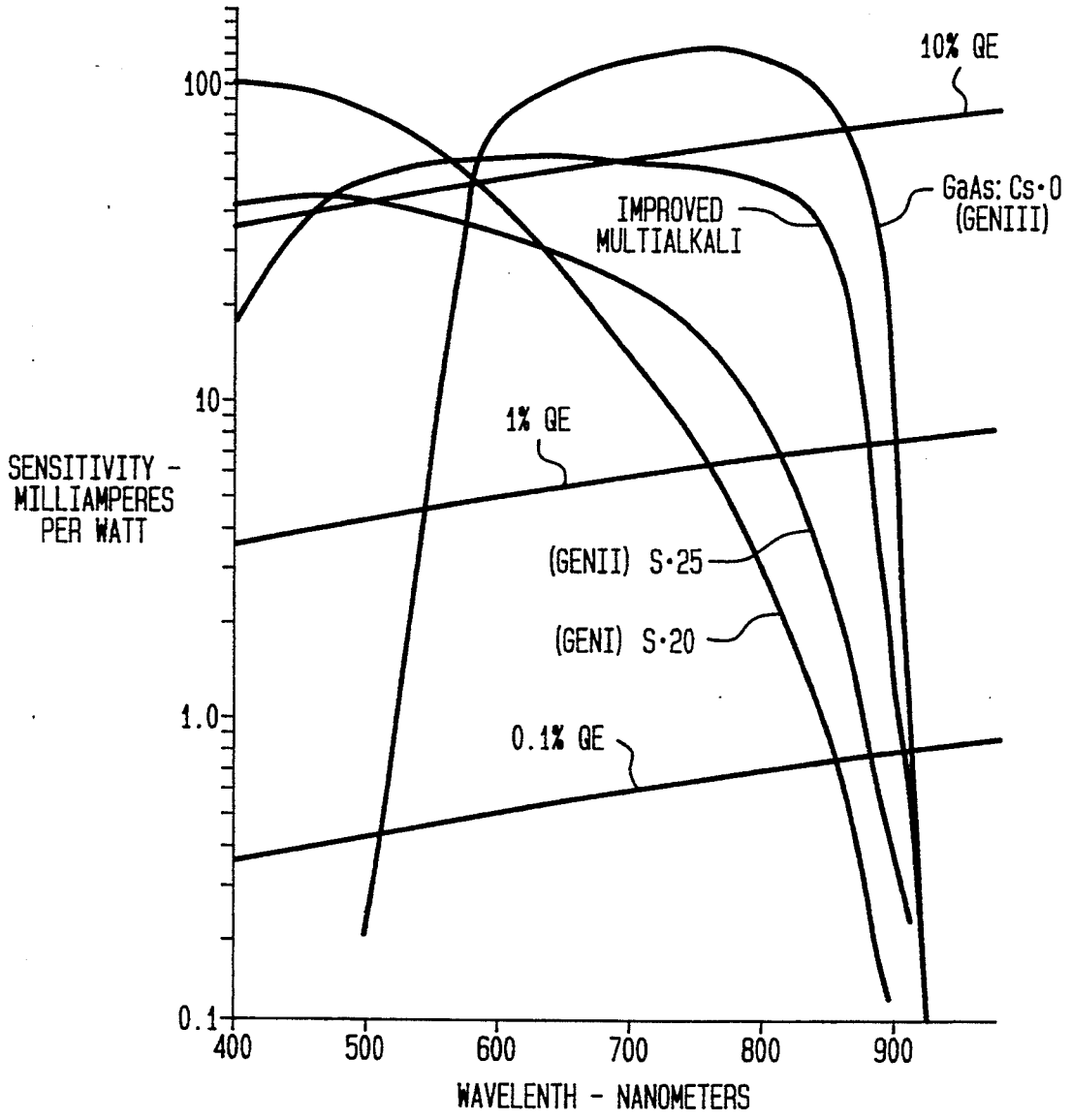
FIG. 2 depicts the spectral response of photocathodes.

Photocathodes are extremely sensitive to low radiation levels of light. Referring to FIG. 2, the spectral response characteristics of the previously described photocathodes is shown. In FIG. 2, 0.1%, 1% and 10% quantum efficiency (QE) lines are shown and the abscissa is the wavelength of incident radiation in nanometers and the ordinate is the sensitivity of the photocathode in milliamperes per watt. As can be seen, the GaAs: Cs·O photocathode has improved sensitivity in the 580–900 nm spectral range relative to the other photocathodes. In accordance with the present invention, the photoemissive wafer 14 is fabricated from GaAs: Cs·O.

Referring back to FIG. 1, positioned adjacent to the input window 12 is a microchannel plate (MCP) 16 having an input 18 and an output 20 face. The input 18 face is coated with an insulating film 22 such as aluminum oxide. The insulating film 22 is coated with a conductive coating 24. The conductive coating 24 is essentially grounded due to the internal structure of the tube 10. The conductive coating 24 is approximately 5 angstroms thick and is fabricated from a conductive material such as barium, nickel, tungsten or other conductive material or alloy. The MCP 16 is fabricated from a glass material and operates to multiply the number of electrons impinging on it, resulting in the emission of secondary electrons which in turn causes the emission of more secondary electrons.

The photocathode is susceptible to being bombarded by positive ions from the MCP 16, thus degrading the performance of the photocathode. The insulating film 22 protects the photocathode by acting as an ion barrier, thus protecting the photocathode and maintaining its performance capabilities.

Positioned adjacent to the MCP 16 is an output window 26 having a phosphor screen 28 which together function as an anode. Electrons impinging on the phosphor screen 28 cause the screen to fluoresce.

The photocathode, MCP 16 and the output window 26 are contained in an evacuated housing 25. The input window 12 is sealed within the housing 25 and is surrounded by a flange 30. The flange 30 supports the input window 12 within the housing. A retainer ring 34 seals an end of the tube 10 and supports the output window 26 within the housing 25. The seals provided at the input window 12 and the retainer ring 34 maintain evacuated conditions in the housing 25.

Power is supplied to the photoemissive wafer, the MCP 16 and the phosphor screen 28 by means integral with or external to the housing 25. The previously described electron multiplication or gain within the MCP 16 is essentially controlled by the potential difference applied across the input 18 and output 20 surfaces of the MCP 16.

In operation, a radiation image impinges on the input window 12. The input window 12 receives and transmits light. Light rays penetrate the input window 12 and are directed to the photoemissive wafer 14 which transforms photons of light into electrons. This causes the emission of electrons which are attracted to the MCP 16 which is maintained at a higher positive potential than the photocathode. The electrons penetrate the conductive coating 24 and insulating surface 22 and are received by the input plane 18 of the MCP 16. The MCP 16 then multiplies the number of electrons received from the photoemissive wafer 14 as previously described. The electrons emanating from the MCP 16, which contain information from the input radiation image, impinge on the phosphor screen 28 causing the phosphor screen 28 to fluoresce and reproduce the input image.

Bright source protection circuitry (not shown) is used in conjunction with the tube 10. This circuitry lowers the potential supplied to the photocathode in response to high light conditions. Such circuitry is used in order to alleviate a saturation of channels in the MCP 16 caused by an increase in electrons emitted from the photocathode in response to high light. This saturation causes a degradation of the resolution of the tube 10. The resolution of the tube 10 is dependent upon its ability to resolve line pairs.

However, if the voltage is lowered such that the emitted electrons from the photocathode do not have sufficient energy to penetrate the insulating film 22, they will begin to accumulate on the film. Consequently, the photocathode voltage is essentially lowered to a secondary emission crossover voltage of the insulating film 22. This crossover voltage, commonly known as a tube clamp voltage, causes the image produced by the tube to fade out as the insulating film 22 accumulates a negative charge.

To prevent the image from fading out, the bright source protection circuit clamps the photocathode voltage above the tube clamp voltage. This is achieved by maintaining the photocathode at a power supply clamp voltage. Consequently, the tube 10 has the capability of providing acceptable resolution under severe high light conditions.

However, the tube clamp voltage is variable. Variation in clamp voltage is a result of uncontrolled parameters during tube manufacturing that cause varying surface conditions and thus a range of electrical conductivity. Consequently, the image will fade out if the voltage difference between the power supply clamp voltage and the tube clamp voltage is sufficient to cause electrons to accumulate on the insulating film 22.

In accordance with the present invention, the conductive coating 24 provides surface conductivity to the insulating film 22. The conductive coating 24 alleviates the accumulation of electrons and thus negative charges on the insulating film 22, allows the image to remain intact.

Figure 3:
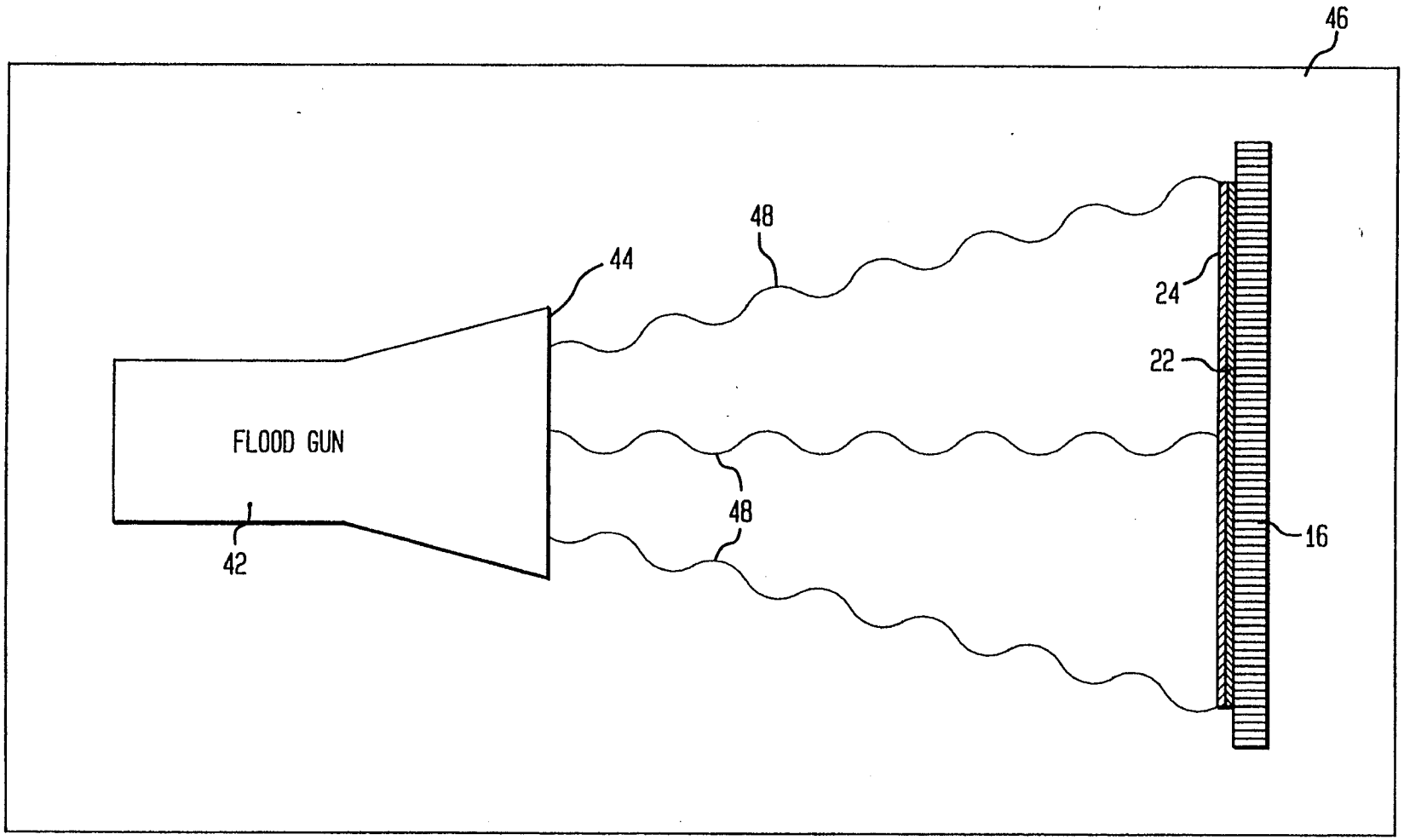
FIG. 3 depicts the forming of a conductive coating in accordance with the present invention by utilizing a flood gun.

FIG. 3 shows a system for forming the conductive coating 24 in accordance with the present invention. A flood gun 42 and MCP 16 with insulating film 22 are positioned in an evacuated chamber 46. An emitting end 44 of the flood gun 42 is positioned toward the insulating film 22. The flood gun 42 is utilized to form the conductive coating 24 on the insulating film 22. Flood guns include a cathode and a heater (not shown). When the heater is utilized to heat the cathode, thermionic emission occurs. The resulting evaporation of the cathode releases conductive material 48 from the emitting end 44 toward the insulating film 22, thus forming the conductive coating 24 on the insulating film 22. The conductive material 48 includes materials such as barium, nickel, tungsten or other conductive materials or alloys. Tests have shown that the use of cathode sublimation as an evaporant source yields an acceptable conductive coating 24 on the insulating film 22.

In these tests, a test portion of the MCP 16 in the tube 10 was subjected to the evaporation of cathode sublimation products. The flood gun 42 was operated for 30 minutes with a current of 1100 milliamperes. Referring to Table 1, results are shown of tests to determine the surface conductivity of the conductive coating 24 on the MCP 16 are shown. Since the thickness of the conductive coating 24 is extremely thin and is difficult to measure by conventional methods, alternate techniques were used. One technique includes measurement of a dead voltage. Dead voltage is an indication of the thickness of the conductive coating 24 as determined by the number of electrons that are able to penetrate the insulating film 22.

TABLE 1

| | Test Area | Outside of Test Area |
|---|---|---|
| Tube Clamp Voltage | 0 | 10–14 |
| Dead Voltage | 245 | 163 |
| Signal to Noise Level | 17.1 | 18.1 |

As can be seen, outside the test area the tube 10 tested normally with tube clamp voltage of 10 to 14 volts. Inside the wedge area, where surface conductivity has been improved, the tube clamp voltage is 0 volts. In addition, the dead voltage outside the wedge shaped area is 163 volts, while within the wedge shaped area the dead voltage increased to 245 volts, indicating that a conductive coating had been evaporated on the insulating film 22. Moreover, the addition of the conductive coating 24 did not significantly decrease the signal to noise level, as the level is 18.1 outside the wedge shaped area and 17.1 within the wedge shaped area.

Figure 4:
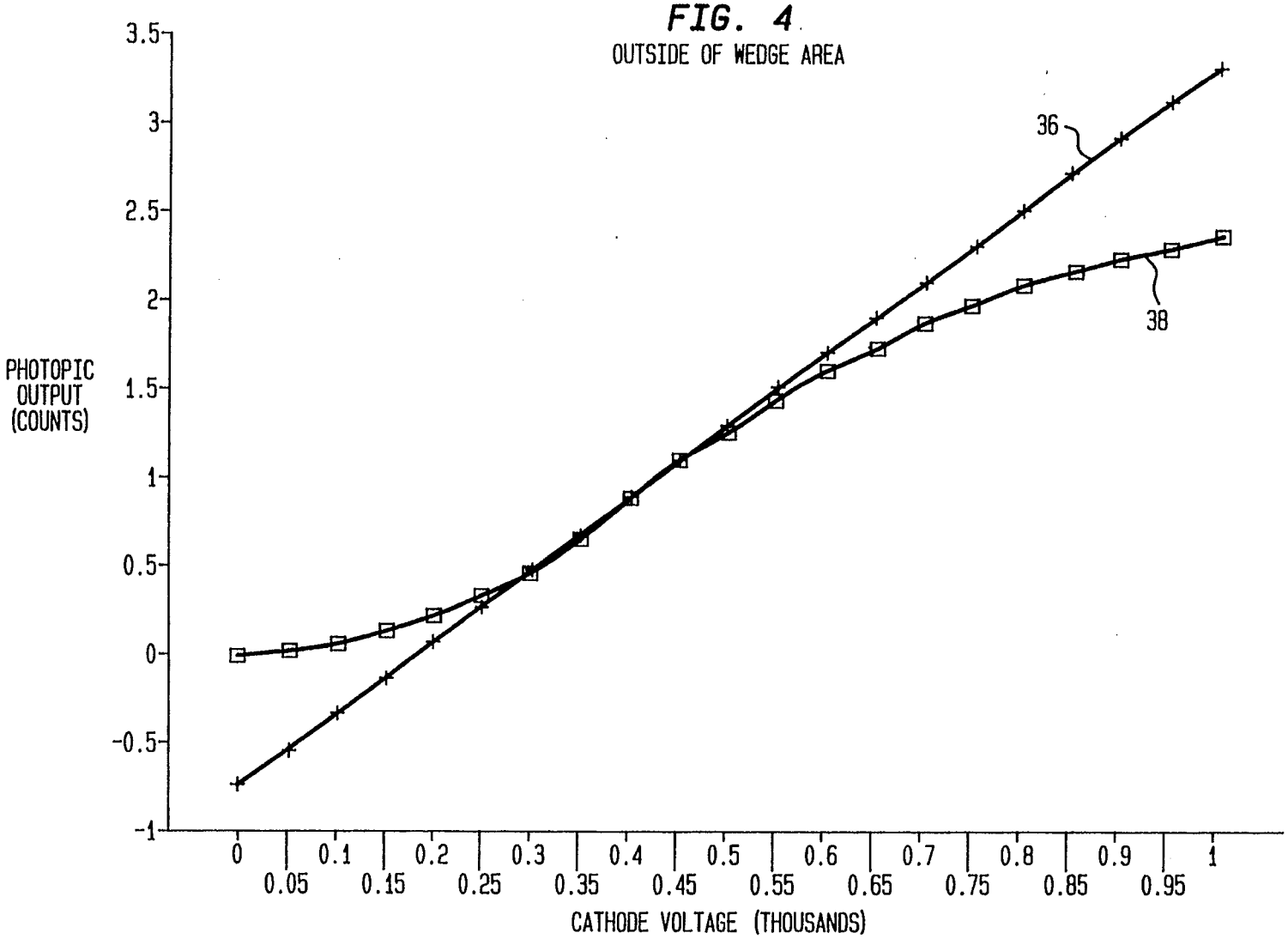
FIG. 4 shows the relationship between photopic output and cathode voltage for a portion of a microchannel plate that has not been subjected to an evaporation of flood gun cathode sublimation products.
Figure 5:
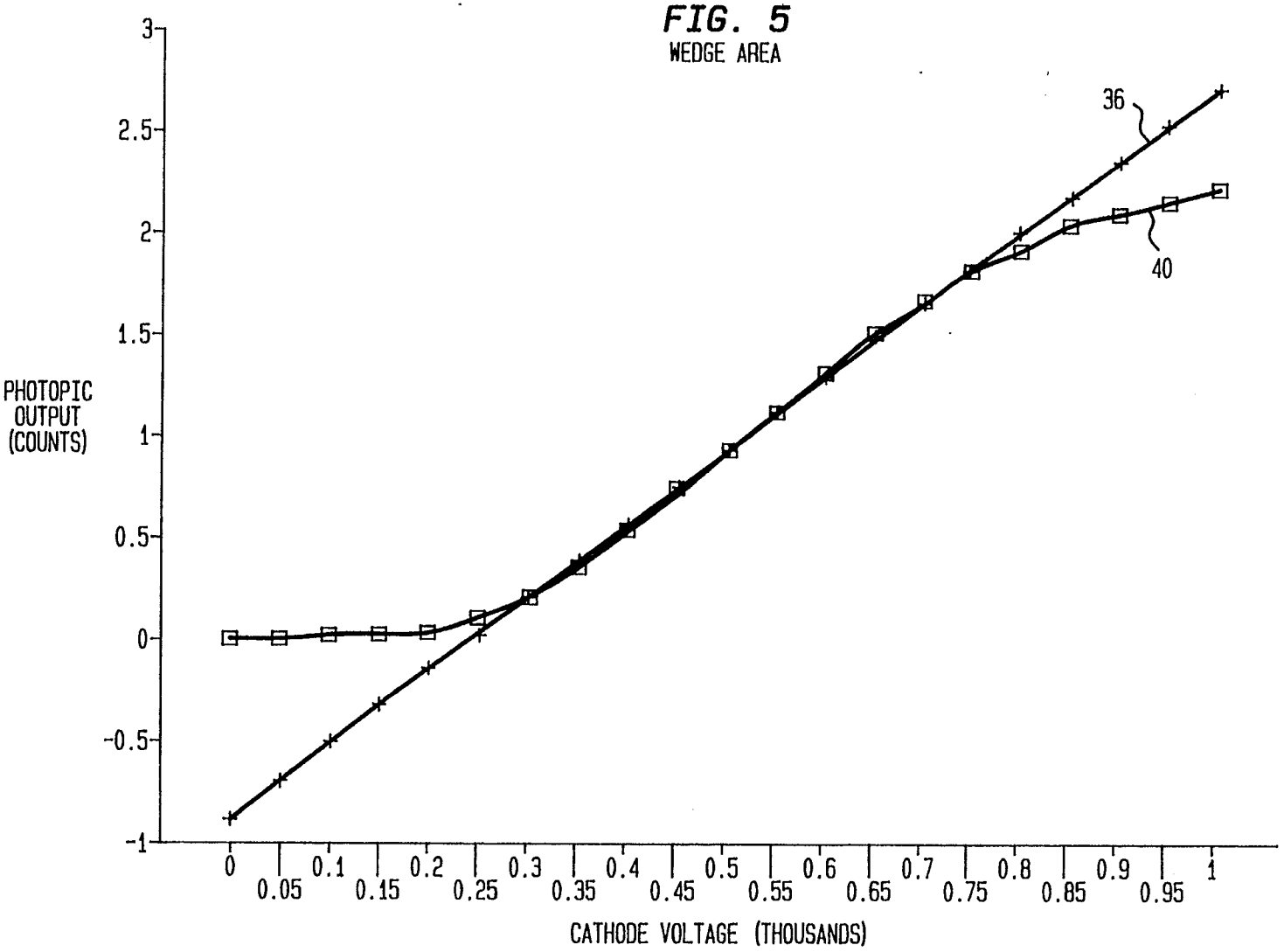
FIG. 5 shows the relationship between photopic output and cathode voltage for a portion of a microchannel plate that has been subjected to an evaporation of flood gun cathode sublimation products.

Referring to FIG. 4 in conjunction with FIG. 4, the relationship between photopic or light output and cathode voltage for the area outside of the wedge (FIG. 4) and the wedge shaped area (FIG. 4) is shown. In an image intensifier tube, a preferred relationship between photopic output and cathode voltage provides that a given increase in cathode voltage produces a linear increase in photopic or light output. This is represented by a straight line 36 in FIGS. 4 and 5. The actual photopic output for the outside of the test area is represented by curve 38 in FIG. 4. The actual photopic output for the test area is represented by curve 40 in FIG. 5. It can be seen that the formation of the conductive coating 24 in the test area results in a more linear relationship between photopic output and cathode voltage and thus is an improvement.

An alternate technique of measuring the thickness of the conductive coating 24 includes measurement of MCP 16 input current. In this technique, a voltage is applied to the MCP 16 while the MCP 16 is bombarded with electrons. A current is then applied to the MCP 16. The thickness of the conductive coating 24 is then indicated by the acceptance level of an MCP 16 input current. A lower current indicates a thicker conductive coating 24.

Further tests were conducted to determine the repeatability of providing the conductive coating 24 by the evaporation of flood gun 42 sublimation products. The tests involved exposing six separate tubes 10 to increasing amounts of evaporated material (tube no. 1 having the least amount of exposure and tube no. 10 having the most) in which the thickness of the conductive coating 24 was indicated by measuring the acceptance level of the MCP 16 input current for 10 minutes. Referring to Table 2, it can be seen that the longer the MCP 16 was subjected to the evaporation of flood gun 42 cathode sublimation products, the lower the MCP 16 input current acceptance, thus indicating a thicker conductive coating 24.

TABLE 2

| Image Intensifier Tube No. | MCP Input Current (microamperes) |
|---|---|
| 1 | 132 |
| 2 | 95 |
| 3 | 93 |
| 4 | 85 |
| 5 | 65 |
| 6 | 54 |

What is claimed is:

1. An image intensifier tube comprising:

a photocathode for creating electrons in response to impinging electromagnetic radiation;

a phosphor screen for converting said electrons into a visible image;

a microchannel plate, disposed between the photocathode and the phosphor screen, for multiplying the electrons produced by the photocathode, said microchannel plate having only one surface facing said photocathode, wherein said surface is substantially non-conducting whereby a negative charge forms on said surface; and a conductive coating covering all of said surface, wherein, said conductive coating dissipates said negative charge from said surface.

2. An image intensifier tube according to claim 1, wherein said conductive coating is selected from a group consisting of barium, nickel, tungsten and combinations thereof.

3. An image intensifier tube according to claim 1, wherein said photocathode includes a photoemissive wafer fabricated from gallium arsenide.

4. An image intensifier tube according to claim 1, wherein said surface reduces ionic bombardment of said photocathode by said microchannel plate.

5. An image intensifier tube according to claim 1, wherein said conductive coating has a thickness of approximately 5 angstroms.

6. The image intensifier tube according to claim 1, wherein said insulated surface is ceramic and forms an ion barrier on said microchannel plate.

7. The image intensifier tube according to claim 6, wherein said ceramic includes aluminum oxide.

8. The image intensifier tube according to claim 1, further includes a means for coupling said conductive coating to ground.

9. In an image intensifier tube of the type having a microchannel plate disposed between a photocathode and a phosphor screen, wherein said photocathode produces electrons that impinge upon one surface of said microchannel plate, said surface having an insulating material disposed thereon, on which a negative charge forms causing an image produced by said tube to undesirably fade out, a method of removing said negative charge comprising the step of:

completely covering said insulating material with a conductive coating, wherein electrons impinge said conductive coating; and coupling said conductive coating to a ground potential for dissipating said negative charge from said insulating material.

10. An image intensifier tube according to claim 9, wherein said conductive coating is selected from a group consisting of barium, nickel, tungsten and combinations thereof.

11. An image intensifier tube according to claim 9, wherein said conductive coating is formed to have a thickness of approximately 5 angstroms.

12. An image intensifier tube according to claim 9, wherein said conductive coating is sublimated on said insulating material.

13. A microcharmel plate for use in an image intensifier tube comprising:

a structure having a multitude of apertures formed therethrough, said structure producing secondary emissions of electrons when impinged upon by an electron stream thereby multiplying the number of electrons in an election stream;

at least one insulating layer covering at least one side of said structure upon which said electron stream impinges, said insulating layer creating an ion barrier that restricts ionic emissions from said structure, at least one conductive layer covering said insulating layer, wherein said at least one conductive layer dissipates any charge formed on said insulating layer.

14. The microchannel plate according to claim 13, wherein said at least one conductor layer is approximately 5 angstroms thick.

15. The microchannel plate according to claim 13, wherein said at least one insulating layer includes a ceramic.

16. The microchannel plate according to claim 13, wherein said at least one conductive layer is selected from a group consisting of barium, nickel, tungsten and combinations thereof.

* * * * *

UNITED STATES PATENT AND TRADEMARK OFFICE

CERTIFICATE OF CORRECTION

PATENT NO. : 5,402,034

DATED : MARCH 28, 1995

INVENTOR(S) : Walter E. Blouch, Daniel D. Duggan and Larry E. Reed

It is certified that error appears in the above-identified patent and that said Letters Patent is hereby corrected as shown below:

Col 8, Claim 13, Line 1 delete "microcharmel" and insert — microchannel —.

Signed and Sealed this

Twenty-third Day of May, 1995

*Attest:*

*Attesting Officer*

Bruce Lehman

BRUCE LEHMAN

*Commissioner of Patents and Trademarks*